United States Patent [19]

Suzuki et al.

[11] 4,150,647

[45] Apr. 24, 1979

[54] FEEDBACK FUEL SUPPLY CONTROL SYSTEM HAVING ELECTROSTATIC FLOW RATE REGULATOR FOR INTERNAL COMBUSTION ENGINE

[75] Inventors: Suzuo Suzuki, Yokosuka; Kenji Masaki, Yokohama; Hatuo Nagaishi, Yokosuka, all of Japan

[73] Assignee: Nissan Motor Company, Limited, Japan

[21] Appl. No.: 843,026

[22] Filed: Oct. 17, 1977

[30] Foreign Application Priority Data

Oct. 18, 1976 [JP] Japan ..... 51-123856

[51] Int. Cl.[2] ..... F02B 51/04; F02B 33/00

[52] U.S. Cl. ..... 123/119 E; 123/119 EC; 261/DIG. 39

[58] Field of Search ..... 123/119 E, 119 EC; 261/118, DIG. 39; 239/533.3, 15, 536; 60/39.82 S

[56] References Cited

U.S. PATENT DOCUMENTS

| | | | |
|---|---|---|---|
| 2,656,824 | 10/1953 | Devaux | 123/119 E |
| 2,766,582 | 10/1956 | Smith | 123/119 E |
| 3,841,824 | 10/1974 | Bethel | 123/119 E X |
| 4,034,728 | 7/1977 | Saufferer et al. | 123/119 E |
| 4,077,374 | 3/1978 | Willmann et al. | 123/119 E |
| 4,082,070 | 4/1978 | Saufferer et al. | 123/119 E |
| 4,085,717 | 4/1978 | Willmann et al. | 123/119 E |

FOREIGN PATENT DOCUMENTS

| | | | |
|---|---|---|---|
| 2461126 | 7/1975 | Fed. Rep. of Germany | 123/119 E |
| 2433125 | 1/1976 | Fed. Rep. of Germany | 123/119 E |
| 2521141 | 11/1976 | Fed. Rep. of Germany | 123/119 E |

*Primary Examiner*—Wendell E. Burns
*Attorney, Agent, or Firm*—Lane, Aitken & Ziems

[57] ABSTRACT

A fuel supply control system comprising an electrostatic apparatus which produces an electric field in a section of a fuel discharge passage to cause a variation in the fuel flow rate in this section, a flow rate detector to provide a feedback signal representing an actual fuel flow rate and an electronic controller which controls the strength and/or polarity of the electric field so as to cancel any deviation of the detected actual fuel flow rate from an optimum flow rate determined by sensing some variables related to the operating condition of the engine.

9 Claims, 9 Drawing Figures

FEEDBACK FUEL SUPPLY CONTROL SYSTEM HAVING ELECTROSTATIC FLOW RATE REGULATOR FOR INTERNAL COMBUSTION ENGINE

BACKGROUND OF THE INVENTION

This invention relates to a feedback control system for the control of a fuel supply rate to an internal combustion engine, and more particularly to a fuel supply control system comprising an electrostatic flow rate control apparatus which has no mechanically moving part and a flow rate detector which provides an electrical signal.

A fuel supply system for an internal combustion engine comprises a fuel metering device or an air-fuel proportioning device such as a fuel injector or a carburetor to feed the engine with an air-fuel mixture of an intended air/fuel ratio. In recent years, there is a strong and growing demand for improvement on the precision in the control of the air/fuel ratio, particularly for automotive internal combustion engines, since the improvement is almost a requisite to the success in reducing harmful components of the exhaust gas and lessening the fuel consumption per mile to the extent of fully meeting current requirements without a substantial sacrifice of the operability of the engines.

To maintain the air/fuel ratio exactly at an intended value, there is a need of precisely controlling the rate of fuel supply in accordance with changes in the quantity of air being admitted into the engine. It is a current trend in automotive internal combustion engines, therefore, to employ an electronic fuel supply control system which includes an electromechanical device such as an electromagnetic valve for minutely varying the fuel supply rate and an electronic control unit for operating the electromechanical device based on certain variables related to the admission of air into the engine or operating condition of the engine. In practical applications, however, the performance of this type of fuel supply control system is not always fully satisfactory because there are limits to the responsiveness and durability of the electromechanical flow rate control device.

In this connection, an electrostatic apparatus for controlling the volumetric flow rate of a liquid which apparatus has no mechanically moving part is disclosed in Japanese patent application Nos. 51(1976)-51694 and 51(1976)-73874, 51(1976)-62911 and U.S. patent application Ser. Nos. 794,137 by H. Maruska. This flow rate control apparatus comprises a pair of electrodes disposed in a liquid passage with a short interval therebetween, a high voltage DC power supply and a controller to vary the magnitude and/or polarity of a DC voltage applied to the electrodes. When a DC high voltage of 1–100 kV is applied to the electrodes, an electric field is produced in the liquid between the electrodes and causes the liquid particles to be charged with the result that a propulsive stress is imposed on the liquid. Consequently the liquid in the electric field migrates toward one of the electrodes. The direction of the liquid flow thus produced with respect to the porality of the voltage applied to the electrodes depends on the kind of the liquid. For example, gasoline tends to flow toward the positive electrode. If the two electrodes are disposed in a stream of gasoline with the interval therebetween in the directon of the stream, the linear velocity of the stream and hence the volumetric flow rate of the gasoline can usually be enhanced by the application of a DC high voltage to the electrodes with the downstream side electrode as a positive electrode and can be lowered by reversing the polarity. The scale of the enhancement or lowering can be controlled by varying the magnitude of the applied voltage.

SUMMARY OF THE INVENTION

It is an object of the present invention to provide a fuel supply control system of a feedback control type for an internal combustion engine, which control system includes an electrostatic apparatus for minutely varying the volume flow rate of fuel streaming in a fuel passage without relying on any mechanically moving element and employs an electrical signal representing a realized flow rate of the fuel as a primary feedback signal.

For an internal combustion engine provided with a fuel supply means for introducing a fuel through a fuel passage into an induction passage through which air is admitted, a fuel supply control system according to the invention comprises (a) two electrodes disposed in the fuel passage with an interval therebetween, (b) power supply means for applying a DC high voltage to these electrodes thereby to produce an electric field in the fuel present between the two electrodes, (c) an electronic controller for controlling at least one of the magnitude, polarity and duration of the DC high voltage applied to the two electrodes, (d) a flow rate detector which is disposed in the fuel passage at a distance from the two electrodes and provides an electrical signal representing an actual fuel flow rate in the fuel passage, and (e) at least one sensor means each for sensing a variable related to the operating condition of the engine and providing an electrical signal representing the sensed variable. The controller is to constructed as to establish an optimum fuel flow rate in the fuel passage through the control of the DC high voltage based on the signals provided by the sensor means and cancel any deviation of an actual fuel flow rate indicated by the signal provided by the flow rate detector from the optimum fuel flow rate through corrective control of the DC high.

The two electrodes and the DC high voltage circuit in this control system constitute the electrostatic flow rate control apparatus hereinbefore referred to. The two electrodes can variously be shaped so far as they do not offer any significant obstruction to the flow of fuel through the fuel passage. For example, the electrodes may individually take the form of a perforated plate, net, porous metal mass of an open-cellular structure, needle, knife blade, or tube. A block of an insulating material forming therein a flow-constricting orifice may optionally be interposed between the two electrodes.

It is possible to utilize a device for measuring a potential difference arisen within a section adjacent and downstream of the two electrodes as the flow rate detector since this potential difference is proportional to the flow rate of electrically charged fuel particles.

To facilitate the migration of the fuel in the electric field produced between the two electrodes, the flow rate control apparatus may optionally be supplemented by a corona discharge circuit of which electrodes are disposed in the fuel passage at a section upstream of the aforementioned two electrodes.

Examples of variables adoptable as relate to the operating condition of the engine are engine speed, throttle valve opening degree and oxygen concentration in the exhaust gas.

Preferably, the electronic controller has the function of providing a high DC voltage in the form of a series of pulses with a constant amplitude and a variable mark-to-space ratio.

A fuel supply control system according to the invention can realize an optimum fuel supply rate with high precision due to the feedback of an actual fuel flow rate and features improved responsiveness and reliability because of using no moving part for varying the fuel flow rate. Accordingly this system makes a great contribution to a substantial improvement on the precision in the control of air/fuel ratio particularly for automotive engines.

DESCRIPTION OF PREFERRED EMBODIMENTS

Figure 1:
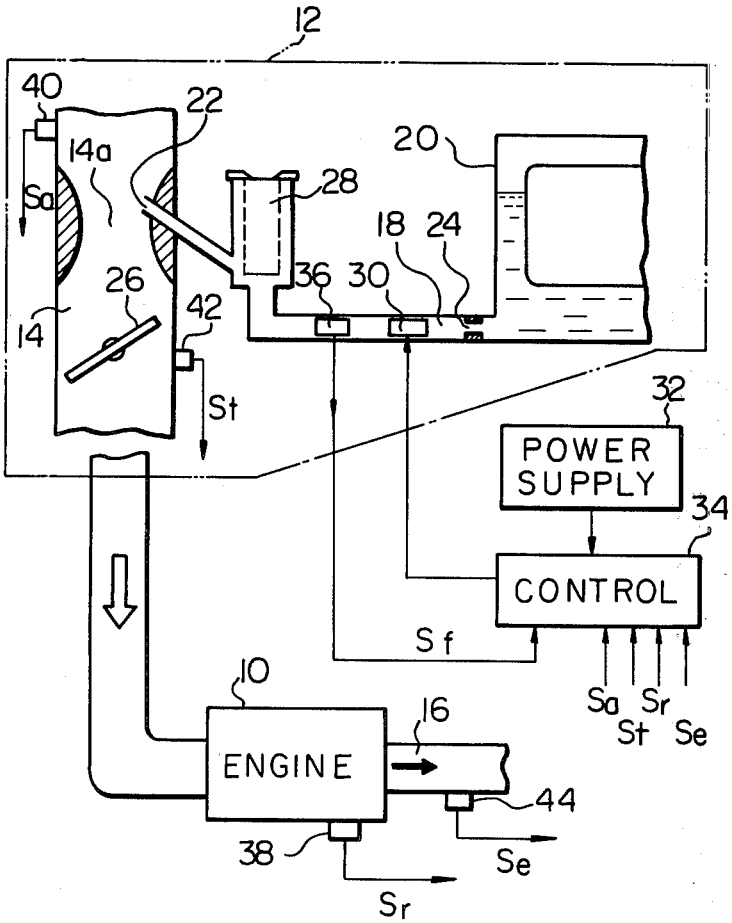
FIG. 1 shows the fundamental construction of a fuel supply control system according to the invention applied to an internal combustion engine equipped with a carburetor.

FIG. 1 shows an internal combustion engine system including a carburetor and a fuel supply control system as an embodiment of the invention. An automotive internal combustion engine 10 is equipped with a carburetor 12 in a usual manner. Reference numerals 14 and 16 indicate an induction passage and an exhaust passage, respectively. In the carburetor 12, a main fuel discharge passage 18 connects a float chamber 20 to a main fuel nozzle 22 which opens into the induction passage 14 at its venturi section 14*a*. A usual throttle valve is indicated at 26. A metering orifice 24 of a fixed area is formed in the fuel passage 18 to determine a standard fuel flow rate. The fuel discharge passage 18 is provided with a main air bleed passage 28 to admit a suitable quantity of air into the fuel at a section between the metering orifice 24 and the nozzle 22. Though omitted from illustration, the carburetor 12 may have a slow-speed fuel discharge passage which branches from the main fuel discharge passage 18 and terminates at a slow-speed fuel nozzle opening into the induction passage 14 at a section slightly downstream of the throttle valve 26. In these respects the carburetor 12 has a well known construction.

An electrostatic flow rate control apparatus for minutely controlling the volumetric flow rate of the fuel in the passage 18 consists fundamentally of an electrode assembly, generally indicated at 30, disposed in the fuel passage 18 at a section between the metering orifice 24 and the air bleed passage 28, a high voltage DC power supply 32 whose output voltage is at a level of 1–100 kV located outside of the fuel passage 18 and an electronic controller 34 interposed between the power supply 32 and the electrode assembly 30 to control the magnitude and/or polarity of a DC voltage to be applied to the electrode assembly 30. The electrode assembly 30 comprises two electrodes with an interval therebetween and, when a DC voltage is applied thereto, produces an electric field in the fuel present between them, so that a propulsive stress is imposed on the fuel toward one of these electrodes. The volumetric flow rate of the fuel, therefore, can be varied by varying the magnitude, polarity and/or duration of the applied DC voltage. Further particulars of the electrode assembly 30 will be described hereinafter.

A flow rate detector 36 which produces an electrical signal $S_f$ representing the detected flow rate of the fuel is disposed in the fuel passage 18 at a section between the electrode assembly 30 and the air bleed passage 28. The signal $S_f$ is supplied to the controller 34 as a feedback signal.

The electrostatic flow rate control apparatus (30, 32, 34) and the flow rate detector 36 are essential components of a fuel supply control system according to the invention. In addition, the control system includes some sensors each of which provides an electrical signal representing an operating parameter of the engine 10, i.e. a certain variable related to the operating condition of the engine 10. In FIG. 1, these sensors are shown as an engine speed sensor 38 providing a signal $S_r$, an air flow rate sensor 40 which provides a signal $S_a$ representing the flow rate of air in the induction passage 14, a sensor 42 whose output $S_t$ represents the opening degree of the throttle valve 26 and an exhaust gas sensor 44 which provides a signal $S_e$ representing the concentration of a certain component, for example oxygen, of the exhaust gas of the engine 10. The controller 34 varies its output, for example the magnitude of the output voltage, according to the values for the variables represented by these signals $S_r$, $S_t$, $S_a$ and/or $S_e$. For example, if the signal $S_e$ indicates that an air/fuel ratio realized in the engine 10 is above a predetermined ratio, the controller 34 varies its output such that the strength of an electric field produced in the electrode assembly 30 varies in a way to an augment of the volumetric flow rate of fuel in the passage 18.

The controller 34 is so constructed as to find an optimum fuel flow rate in the passage 18 from the variables as indicated by the signals $S_r$, $S_t$, $S_a$ and/or $S_e$ and provide an output voltage needful for making the condition of the electric field in the electrode assembly 30 commensurate with the optimum fuel flow rate. Furthermore, the controller 34 has the function of comparing an actual fuel flow rate indicated by the feedback signal $S_f$ with the optimum flow rate found therein and minutely varying its output voltage to cancel a deviation, if any, of the actual flow rate from the optimum flow rate. In this sense, the controller 34 does not fundamentally differ from hitherto developed electronic air/fuel ratio controllers for automotive internal combustion engines, providing a control signal to an electromechanical flow control device with the employment of oxygen concentration in the exhaust gas as a primary feedback signal.

The controller 34 may be so constructed as to produce its output voltage either continuously with a variable amplitude or intermittently at variable intervals based on the comparison of the feedback signal $S_f$ with the optimum fuel flow rate found in the controller 34. Alternatively the output voltage of the controller 34 may take the form of a series of pulses produced at a constant frequency, wherein the ratio of the width of each pulse to the interval to a next pulse is varied based on the aforementioned comparison. In any case, a change in the output voltage of the controller 34 may be proportional to a deviation of an actual fuel flow rate from an optimum flow rate found in the controller 34 and/or be commensurate with an integration of the deviation with respect to time.

Optionally a slow-speed fuel discharge passage (omitted from illustration) may also be provided with a fuel supply control system of the above described type.

Several examples of the electrode assembly 30 are presented in FIGS. 2–5, wherein the arrow F indicates the direction of a fuel stream in the fuel passage 18.

Figure 2:
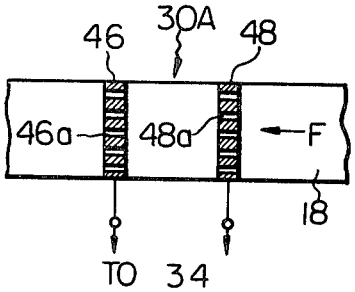
FIGS. 2–5 show in schematic and sectional views four types of electrode assemblies as a principal element of an electrostatic flow rate control apparatus employed in the control system of FIG. 1.

In FIG. 2, an electrode assembly 30A consists of an electrode 46 in the shape of a plate having a number of apertures 46*a* and another plate-shaped electrode 48 with a number of apertures 48*a*. These two electrodes 46 and 48 each fits to the inside of the fuel passage 18 on the periphery and are arranged with a short distance therebetween in the direction of the fuel stream F. When the fuel passage 18 is formed in an electrically conductive body, there is a need of interposing insulators (not shown) between the individual electrodes 46, 48 and the wall of the fuel passage 18. As a modification of a perforated metal plate as the form of the electrodes 46 and/or 48, it is possible to use a net of a metal wire, or a porous metal mass having an open cellular structure such as a sponge metal, a sintered metal mass or an irregularly meshy structure of a metal wire.

Figure 3:
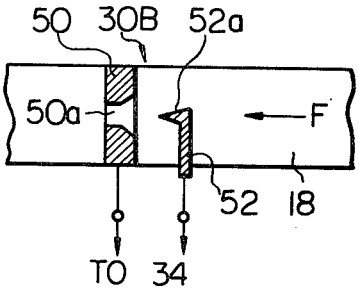

In FIG. 3, an electrode assembly 30B consists of a generally ring-shaped electrode 50 having a through hole 50*a* with its longitudinal axis in the direction of the fuel stream F and another electrode 52 an end portion 52*a* of which is needle-shaped with an interval from and axially in alignment with the hole 50*a* of the electrode 50. The needle-shaped electrode 52 has the advantage that it offers the least resistance to the fuel stream F and adds and impulsive effect on the migration of the fuel in an electric field produced by the electrodes 50, 52. Alternatively the electrode 52 may have the shape of a knife blade.

Figure 4:
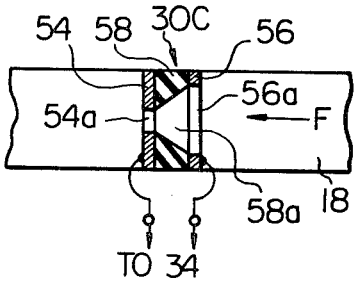

In FIG. 4, an electrode assembly 30C has two electrodes 54 and 56 each in the shape of a thin plate with an aperture 54*a* or 56*a* in its central region and, additionally, a block 58 which is made of an electrically insulating material and has a through hole 58*a* tapered in the direction of the fuel stream F. Conveniently the hole 58*a* has the shape of a truncated cone oriented such that the streaming fuel passes through the hole 58*a* from the base of the cone to the truncated end. The two plate electrodes 54 and 56 are placed respectively on both sides of the insulating member 58, and the apertures 54*a* and 56*a* of these electrodes 54, 56 respectively have sufficiently large areas so as not to cover the both ends of the tapered hole 58*a*. This electrode assembly 30C is convenient for manufacture and assemblage, and the truncated conical shape of the hole 58*a* aids the migration of the fuel in an electric field produced in the hole 58*a*. Besides, this assembly 30C can serve as a metering orifice too.

Figure 5:
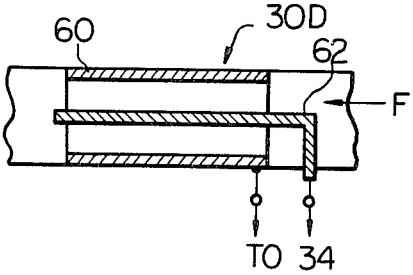

An electrode assembly 30D of FIG. 5 consists of a tubular electrode 60 with its longitudinal axis in the direction of the fuel stream F and another electrode 62 which is a rod or wire inserted coaxially into the tubular electrode 60. In this case, an electric field produced in the tubular electrode 60 causes the fuel to migrate laterally of the direction of the stream F.

Figure 6:
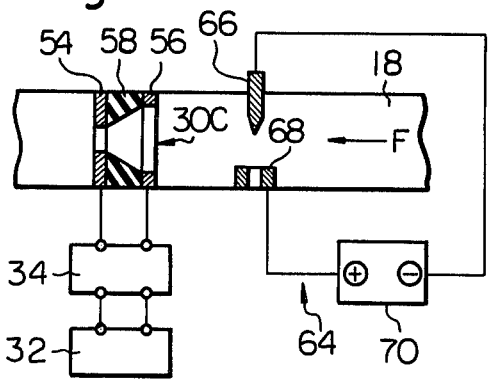
FIG. 6 is a schematic and sectional view of a flow rate control apparatus having the electrode assembly of FIG. 4 and, additionally, a corona discharge circuit as an auxiliary element.
Figure 7:
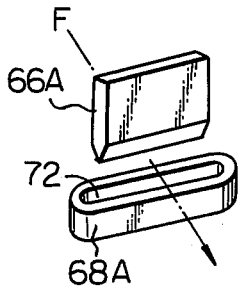
FIGS. 7 and 8 are perspective views of two differently designed pairs of electrodes for the corona discharge circuit in FIG. 6.

Referring to FIG. 6, the above described flow rate control apparatus may optionally be supplemented by a corona discharge circuit 64 which is arranged such that corona discharge occurs in the fuel flowing through the passage 18, conveniently in a direction substantially normal to the direction of the fuel flow F, at a section upstream of the electrode assembly 30 (illustrated as the assembly 30C of FIG. 4 by way of example). This circuit 64 includes negative and positive electrodes 66 and 68 disposed in the fuel passage 18 with a distance therebetween in the direction normal to the fuel stream F and a DC high voltage power supply 70 which may include a discharge controller. When the wall of the fuel passage 18 is conductive, insulators (not shown) are interposed between the wall and the electrodes 66, 68. As shown in FIG. 7, the negative electrode 66 has preferably the shape of a knife blade 66A, while the positive electrode 68 in this example is a plate member 68A having an elongate slit 72 which would receive the blade 66A if the electrodes 66 and 68 were contacted.

The application of a DC high voltage to the electrodes 66, 68 causes corona discharge in the fuel, so that the fuel arrives at the electrode assembly 30C in an electrically charged state. This is of great aid for realizing the intended migration of the fuel in the electric field described hereinbefore particularly when the fuel is a liquid rather insensitive to an electric field as exemplified by hexane. The use of the corona circuit 64 in combination with the electrode assembly 30 brings about an enlargement of the scope of flow rate control by a fuel supply control system according to the invention.

Figure 8:
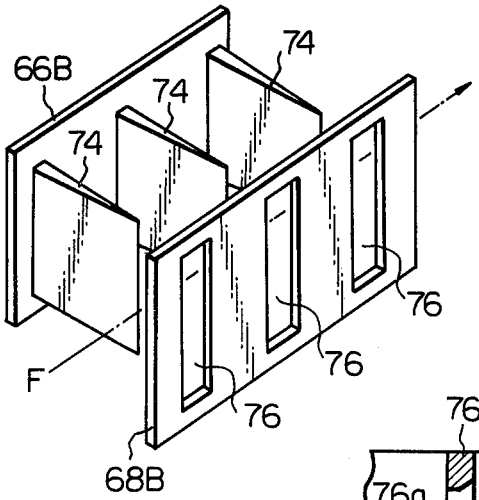

The effect of the corona discharge circuit 64 can be augmented by the employment of a multi-electrode assembly as shown in FIG. 8 by way of example. In this case a negative electrode 66B has three parallel blades 74 arranged in file in the direction of the fuel stream F, and a positive electrode 68B has three slits 76 arranged opposite to the three blades 74, respectively.

There is no particular restriction on the type of the flow rate detector 36. For example, it is possible to use a wobble plate type device disclosed in Japanese Patent Application No. 50 (1970)-83883 and U.S. patent application Ser. No. 703,292 now U.S. Pat. No. 4,089,221.

Figure 9:
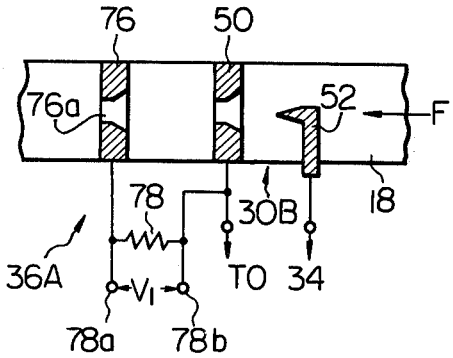
FIG. 9 is a schematic and sectional presentation of a flow rate detector in the control system of FIG. 1 associated with the electrode assembly of FIG. 3.

As a convenient embodiment of the flow rate detector 36 in a control system according to the invention, FIG. 9 shows a device 36A which is based on the fact that, since the fuel particles are electrically charged by a high DC voltage applied to the electrode assembly 30, a fuel flow rate in the passage 18 at a section downstream of the electrode assembly 30 (illustrated as the assembly 30B of FIG. 3 by way of example) can be detected by measuring the amount of electric charge carried by the fuel per unit amount of time. In the case of FIG. 9, a ring-like electrode 76 is disposed in the fuel passage 18 at a section downstream of the electrode 50 which is positioned downstream of the other electrodes 52 of the electrode assembly 30B, and a resistor 78 is connected between the electrodes 50 and 76. A potential difference $V_1$ arisen between the two terminals 78*a* and 78*b* of the resistor 78 indicates the fuel flow rate in a section between the two electrodes 50 and 76 since the potential difference $V_1$ is proportional to the volume rate of flow of the charged fuel.

What is claimed is:

1. A fuel supply control system for an internal combustion engine provided with a fuel supply means for introducing a fuel through a fuel passage into an induction passage through which air is admitted, the control system comprising:

two electrodes disposed in the fuel passage with an interval therebetween, power supply means for applying a DC high voltage to said two electrodes thereby to produce an electric field in the fuel present between said two electrodes;

an electronic controller for controlling at least one of the magnitude, polarity and duration of said DC high voltage;

a flow rate detection means for providing an electrical signal representing an actual fuel flow rate in the fuel passage detected in a section at a distance from said two electrodes; and at least one sensor means each for sensing a variable related to the operating condition of the engine and providing an electrical signal representing the sensed variable;

said controller being so constructed as to establish an optimum fuel flow rate in the fuel passage through the control of said DC high voltage based on the signals provided by said at least one sensor means and cancel any deviation of an actual fuel flow rate represented by the electrical signal provided by said flow rate detection means from said optimum fuel flow rate through corrective control of said DC high voltage.

2. A fuel supply control system as claimed in claim 1, further comprising a corona discharge circuit arranged such that corona discharge occurs in the fuel passage at a section upstream of said two electrodes.

3. A fuel supply control system as claimed in claim 2, wherein said corona discharge circuit comprises two electrodes disposed in the fuel passage with an interval therebetween in a directon substantially normal to the direction of the fuel flow in the fuel passage.

4. A fuel supply control system as claimed in claim 1, wherein said two electrodes are arranged with an interval therebetween substantially in the direction of the fuel flow in the fuel passage.

5. A fuel supply control system as claimed in claim 4, further comprising a block of an insulating material interposed between said two electrodes, said block having a tapered through hole to provide a liquid passage between said two electrodes with the largest cross-sectional area at the upstream end thereof.

6. A fuel supply control system as claimed in claim 1, wherein said two electrodes are arranged with an interval therebetween in a direction substantially normal to the direction of the fuel flow in the fuel passage.

7. A fuel supply control system as claimed in claim 1, wherein said flow rate detection means detect said actual flow rate in a section downstream of said two electrodes.

8. A fuel supply control system as claimed in claim 7, wherein said flow rate detection means comprise voltage detection means for detecting a potential difference produced within a section of the fuel passage downstream of said two electrodes by the flow of the fuel in a charged state.

9. A fuel supply control system as claimed in claim 8, wherein said two electrodes are arranged with an interval therebetween substantially in the direction of the fuel flow in the fuel passage, said flow rate detection means comprising another electrode disposed in the fuel passage at a section downstream of said two electrodes and a resistor connected between said another electrode and one of said two electrodes located on the downstream side.

* * * * *